United States Patent [19]

Shaffer

[11] Patent Number: 5,022,880

[45] Date of Patent: Jun. 11, 1991

[54] METHOD OF CONSTRUCTING AN ELECTRIC LAMP USING CARBON MONOXIDE AS A FORMING GAS

[75] Inventor: John W. Shaffer, Danvers, Mass.

[73] Assignee: GTE Products Corporation, Danvers, Mass.

[21] Appl. No.: 471,637

[22] Filed: Jan. 29, 1990

[51] Int. Cl.[5] ..... H01J 9/44

[52] U.S. Cl. ..... 445/6

[58] Field of Search ..... 445/6

[56] References Cited

U.S. PATENT DOCUMENTS

| | | | |
|---|---|---|---|
| 2,041,610 | 5/1936 | Killian | 445/6 |
| 3,364,376 | 1/1968 | Collins et al. | 313/222 |
| 3,492,598 | 1/1970 | MacNair | 445/6 |
| 3,728,572 | 4/1973 | Maier et al. | 313/222 |
| 4,129,348 | 12/1978 | Karlotski | 445/6 |
| 4,163,171 | 7/1979 | Wurster | 313/222 |

*Primary Examiner*—Kenneth J. Ramsey

*Attorney, Agent, or Firm*—Witherspoon & Hargest

[57] ABSTRACT

A method is provided for constructing an electric lamp such as, for example, a tungsten halogen capsule, using carbon monoxide as a reducing gas to remove oxides from lamp components during the manufacture thereof. To this end, prior to evacuation the lamp envelope is filled with a forming gas such as, for example, a carbon monoxide- nitrogen mixture, and the envelope is given one or more light-ups to thereby deoxidize the lamp components.

20 Claims, 1 Drawing Sheet

METHOD OF CONSTRUCTING AN ELECTRIC LAMP USING CARBON MONOXIDE AS A FORMING GAS

BACKGROUND OF THE INVENTION

1. Field of the Invention

The present invention relates to an improved method of fabricating an electric lamp to substantially eliminate the presence of trace impurities within the lamp envelope thereby improving lamp life.

2. Description of the Prior Art

Most lamps in use today are adversely affected by the presence of oxygen or water vapor in the internal lamp atmosphere. This is a particular problem regarding high voltage lamps but can also be a concern with respect to low voltage lamps. Incandescent lamps suffer shortened lamp life and blackening of the inner surface of the lamp bulb as a result of the presence of oxygen and especially water vapor by the well known tungsten-transporting water cycle. This problem is of concern, for example, in a conventional tungsten halogen incandescent lamp. Similarly, fluorescent lamps are subject to erosion of any uncoated cathode wire, and cathode coating emissivity and life are adversely affected by traces of oxygen or water vapor within the lamp. This is well documented in the publication "Poisonous Gas Effects On The Emission Of Oxide-Coated Cathodes", S. Itoh, M. Yokoyama, and K. Morimoto, J. Vac. Sci. Technol., A5(6), pp. 3430–3435, Nov./Dec. 1987. In addition, the presence of hydrogen in a fluorescent lamp can also damage the phosphor and increase lamp starting voltage. Such hydrogen typically is formed in a fluorescent lamp as a result of the dissociation of water vapor.

Incandescent lamps typically contain chemical getters which combine with oxygen or water vapor to remove such impurities from the lamp atmposphere. In addition, the tungsten filament of an incandescent lamp can be freed of any oxides formed, for example, during the sealing of the lamp envelope, by a brief light-up in the presence of a forming gas. This process is effected prior to the final exhausting of the lamp vessel and introduction of the desired fill gas. Typically the forming gas is a mixture of hydrogen in nitrogen. During such light-up procedure, the capsule is given one or more light-ups at the desired voltage while filled with the mixture of hydrogen and nitrogen. The hydrogen chemically reduces any tungsten oxide present to form tungsten metal and by-product water vapor which is then pumped out of the lamp.

It is desired to improve lamp component deoxidation and thereby improve lamp life. It has been observed that such improvement can be accomplished using a mixture of carbon monoxide in nitrogen in place of the hydrogen-containing forming gas.

The use of carbon monoxide in the processing of incandescent lamps is known in the art. However, to date such use has been directed to providing carbon monoxide as a fill gas to be used as an oxygen source. For example, in U.S. Pat. No. 3,364,376 to Collins et al., which issued on Jan. 16, 1968, an iodide cycle incandescent lamp is provided wherein carbon monoxide is a component of the fill gas to enhance the halogen cycle to prevent lamp blackening. It is interesting to note that not only does this patent not teach lamp life enhancement through the use of carbon monoxide, but in fact teaches just the opposite, that is, that lamp life falls off rapidly with increasing carbon monoxide content.

In U.S. Pat. No. 3,728,572 to Maier et al., which issued on Apr. 17, 1973, a halogen incandescent lamp is described. As in the case of the '376 patent, the fill gas comprises carbon monoxide. In Maier et al., the carbon monoxide is used to decrease the level of halocarbon halogen additive needed while maintaining substantially equal lamp life.

In U.S. Pat. No. 4,163,171 to Wurster, which issued on July 31, 1979, a halogen cycle incandescent lamp is described. This patent refers to the operation of such a lamp wherein various materials diffuse out of the glass into the lamp bulb to adversely affect the regenerative cycle. It is noted that the release of carbon monoxide, carbon dioxide, and water during operation of the lamp will speed up the regenerative cycle. This patent essentially relates to high purity lamp glass which will avoid influencing the halogen cycle.

It is interesting to note that none of the known prior art relates to the use of carbon monoxide to increase lamp life. Similarly, none of the known prior art relates to any affect of carbon monoxide other than in the fill gas. It is an object of the present invention to provide an improved fabricating process in which carbon monoxide is used as a cleanup gas during lamp manufacture to improve lamp life and overcome the problems discussed herein. The carbon monoxide gas of the present invention is not used in any way as a fill gas.

SUMMARY OF THE INVENTION

This invention achieves these and other results by providing a method of constructing an electric lamp, the electric lamp comprising a basic lamp structure including an envelope, a plurality of electrical conductors sealed into and passing through the envelope, and at least one filament electrically connected to the electrical conductors. In one preferred embodiment, the electric lamp is a tungsten halogen capsule. The method comprises the steps of (a) forming the basic lamp structure, (b) filling the envelope with a forming gas comprising carbon monoxide, (c) lighting-up the basic lamp structure in the presence of the forming gas, (d) evacuating the envelope when the lighting-up ceases, (e) filling the envelope with a desired fill gas, and (f) sealing the envelope. In a preferred embodiment, after the evacuating step and before filling the envelope with the desired fill gas, the method comprises the further steps of (a) depositing a getter forming component into the envelope, (b) lighting-up the basic lamp structure in the presence of the getter forming component to deposit a getter material in the envelope; and (c) re-evacuating the envelope.

DESCRIPTION OF THE PREFERRED EMBODIMENT

Figure 1:
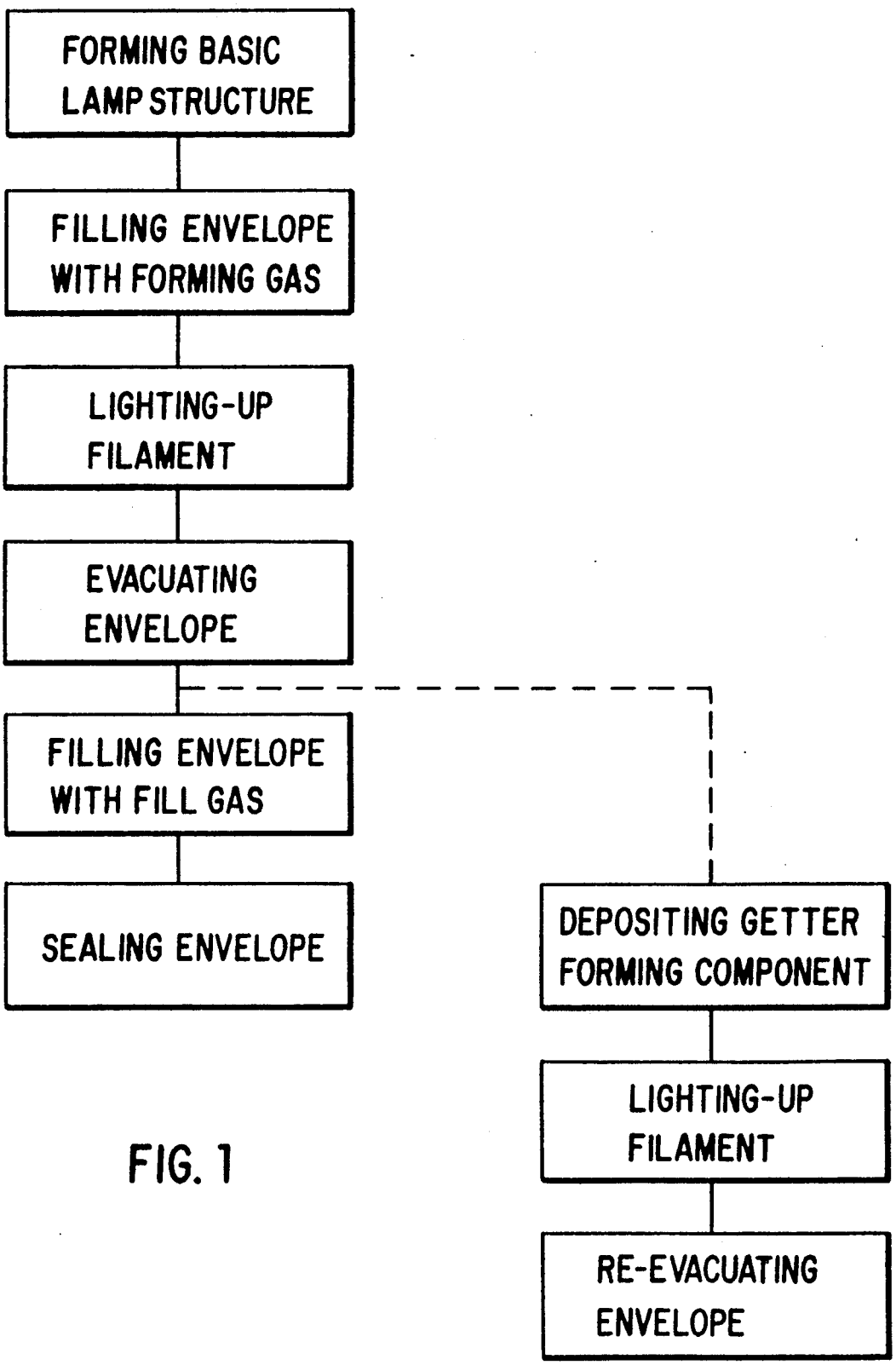
FIG. 1 depicts a flow diagram of a method of constructing an electric lamp in accordance with the present invention.

The embodiment of this invention which is illustrated in the drawing is particularly suited for achieving the objects of this invention. FIG. 1 depicts a flow diagram of a method of constructing an electric lamp according to the present invention. The term electric lamp is to be construed broadly to include all incandescent lamps, capsules, and the like, which comprise an envelope, a plurality of electrical conductors sealed into and passing through the envelope, and at least one filament electrically connected to the electrical conductors. The teachings of the present invention are also applicable to fluorescent lamps. In other words, although the teachings herein are discussed with respect to the manufacture of a tungsten-halogen capsule, the present invention is applicable to the manufacture of any electric lamp.

An incandescent electric lamp such as, for example, a tungsten-halogen capsule, typically includes a glass envelope having a pinch at one end. A pair of electrical conductors are sealed into and pass through the pinch into the cavity of the envelope. Sealed within the envelope is a light source which is usually in the form of a tungsten filament electrically connected to the electrical conductors. A known fill gas is also provided within the sealed envelope. The tungsten filament is typically relatively soft and at high temperatures such as operating temperatures tends to crystalize and become hard and brittle. The presence of oxygen or water vapor in the internal atmosphere of the cavity of the glass envelope has an adverse effect upon the operating life of the tungsten filament. The process of the present invention is to alleviate this problem.

In the process of the present invention what is referred to herein as the basic lamp structure is formed in a conventional manner. A basic lamp structure comprises the envelope or capsule having the electrical conductors and the filament mounted therein. After the basic lamp structure is formed, the envelope is typically filled with a forming gas in a conventional manner. Heretofore, such forming gas has been a hydrogen-containing gas. In the present invention, unexpected results have been obtained from the use of a carbon monoxide-containing forming gas. In the preferred embodiment described herein, the forming gas comprises a mixture of carbon monoxide and an inert gas such as, without limitation, nitrogen. In one embodiment, the forming gas comprises ten percent carbon monoxide, the balance being nitrogen. Preferably the envelope is filled with the forming gas at a pressure of at least one atmosphere. The reason for this is that the typical apparatus used to effect such filling includes numerous hose couplings, valve fittings, and the like. If the filling step is effected at a pressure less than one atmosphere, there will be a tendency for air to leak into the lamp. This is an undesirable result, it being an objective to prevent the presence of any oxygen or water vapor in the final lamp product.

The next step involves lighting-up the basic lamp structure in the presence of the forming gas. For example, a tungsten halogen capsule with electrical conductors and a tungsten filament mounted therein is subjected to one or more light-ups in the presence of the carbon monoxide containing forming gas by subjecting the electrical conductors to the desired voltage. When the lighting-up ceases, the envelope is evacuated, the desired fill gas is provided within the envelope, and the envelope is sealed, all in a conventional manner.

In the preferred embodiment, a getter is provided within the envelope prior to the filling step. To this end, after the evacuating step, the envelope is filled with a getter forming component and the envelope is once again subjected to a conventional lighting-up in the presence of such component. The effect will be that a getter material will be deposited within the envelope. In the preferred embodiment, the getter forming component is a mixture of phosphine in nitrogen and the getter material will be elemental phosphorus. In one embodiment, the getter forming conponent is one percent phosphine in nitrogen. Subsequent to the second lighting-up step, the envelope is re-evacuated, the desired fill gas is provided within the envelope, and the envelope is sealed, in a convention manner.

Table 1 contains results of a series of tests numbered 1 to 4. The results of each test represent an average of twelve lamps; that is, twelve separate lamps were used in each of Tests 1 to 4. In all of the tests, the lamps tested were 45 watt, 92 volt tungsten halogen capsules fabricated from type 180 aluminosilicate glass of 12.5 mm. outside diameter, 1.0 mm. wall thickness, and having an internal volume of 2.3 cubic centimeters. With the exception of the particular reducing gas indentified in Table 1, all of the capsules were the same with the exception that those subjected to Tests 3 and 4 were baked before light-up in an oven for three minutes at 450° C. Each capsule in each test was given two approximately 1.2 second light-ups at 25 and 55 volts, respectively, while filled with the particular reducing gas identified in Table 1. Each capsule tested was filled with the particular gas at a pressure of 800 torr. After light-up, each capsule was evacuated in a conventional manner. After evacuation, a mixture of one percent phosphine in nitrogen was admitted into each capsule at a pressure of 800 torr, and the capsule filament was again lit at 55 volts for a total duration of approximately 2.4 seconds. This second light-up thermally decomposed the phosphine so as to deposit a quantity of elemental phosphorus in the envelope to act as a getter. Each capsule was subjected to re-evacuation, and a final fill gas comprising 0.1 percent hydrogen bromide, 5.0 percent nitrogen, and the balance xenon was admitted to a final pressure of five atmospheres. Each capsule was then tipped off. Table 1 records the average life benefits achieved in each of the four tests:

TABLE 1

| Test | Reducing Gas | Mean Life (Hours) | Standard Deviation |
|---|---|---|---|
| 1 | 20% $H_2$, balance $N_2$ | 1747 | 277 |
| 2 | 10% CO, balance $N_2$ | 2073 | 224 |
| 3 | 20% $H_2$, balance $N_2$ | 1886 | 469 |
| 4 | 10% CO, balance $N_2$ | 2236 | 439 |

Essentially, twelve capsules having a hydrogen-containing forming gas (Test 1) were compared with twelve capsules having a carbon monoxide-containing forming gas (Test 2). Similarly, twelve pre-baked capsules having a hydrogen-containing forming gas (Test 3) were compared with twelve pre-baked capsules having a carbon monoxide-containing gas (Test 4). It will be evident that in both sets of comparisons, the substitution of carbon monoxide as a light-up gas increased average life by about eighteen percent notwithstanding the presence of about 36 micrograms of phosphorus, which can be considered a relatively large quantity of phosphorus. The results show that the effect of pre-baking the capsules (Tests 3 and 4) was to somewhat increase filament life.

Without intending to be bound by a theory of operation, the life gain found with the use of carbon monoxide as a reducing gas may be in part due to its greater thermochemical reactivity for reducing oxides such as tungsten oxides as compared with hydrogen. Additionally, and probably of greater importance, the carbon dioxide reaction by-product formed during the use of carbon monoxide is much easier to remove quantitatively from the lamp vessel than is the water vapor which is formed when hydrogen is used.

The objects of this invention are achieved by using carbon monoxide as an oxide removing light-up or lamp component cleanup gas during lamp manufacture. In the present invention, carbon monoxide is used in the processing of an electric lamp prior to the final evacuation step. In other words, the carbon monoxide is not at all intentionally retained in the finished lamp. In the present invention, the carbon monoxide essentially acts as an oxygen getter during processing of the lamp to reduce tungsten and molybdnum oxides in the coil and leads.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A method of constructing an electric lamp, said electric lamp comprising a basic lamp structure including an envelope, a plurality of electrical conductors sealed into and passing through said envelope, and at least one filament electrically connected to said electrical conductors, said method comprising the steps of:

(a) forming said basic lamp structure;
(b) filling said envelope with a forming gas comprising carbon monoxide;
(c) lighting-up said filament in the presence of said forming gas;
(d) evacuating said envelope when said lighting-up ceases;
(e) filling said envelope with a desired fill gas; and
(f) sealing said envelope.

2. A method as described in claim 1 wherein said filling step includes filling said envelope with a forming gas comprising carbon monoxide and an inert gas.

3. A method as described in claim 2 wherein said inert gas is nitrogen.

4. A method as described in claim 1 wherein said filling step includes filling with said forming gas at a pressure of at least one atmosphere.

5. A method as described in claim 4 wherein said filling step includes filling said envelope with a forming gas comprising carbon monoxide and an inert gas.

6. A method as described in claim 5 wherein said inert gas is nitrogen.

7. A method as described in claim 1 wherein after said evacuating step and before filling said envelope with said desired fill gas, said method comprises the further steps of:

(a) depositing a getter forming component into said envelope;
(b) lighting-up said filament in the presence of said getter forming component to deposit a getter material in said envelope; and
(c) re-evacuating said envelope.

8. A method as described in claim 7 wherein said getter forming component is a mixture of phosphine in nitrogen and said getter material is elemental phosphorus.

9. A method as described in claim 8 wherein said getter forming component is one percent phosphine in nitrogen.

10. A method as described in claim 7 wherein said filling step includes filling said envelope with a forming gas comprising carbon monoxide and an inert gas.

11. A method as described in claim 10 wherein said inert gas is nitrogen.

12. A method as described in claim 11 wherein said filling step includes filling with said forming gas at a pressure of at least one atmosphere.

13. A method as described in claim 12 wherein said getter forming component is a mixture of phosphine in nitrogen and said getter material is elemental phosphorus.

14. A method as described in claim 13 wherein said getter forming component is one percent phosphine in nitrogen.

15. A method of constructing an electric lamp, said electric lamp comprising a basic lamp structure including an envelope, a plurality of electrical conductors sealed into and passing through said envelope, and at least one tungsten filament electrically connected to said electrical conductors, said method comprising the steps of:

(a) forming said basic lamp structure;
(b) filling said envelope with a forming gas comprising carbon monoxide and an inert gas at a pressure of at least one atmosphere;
(c) lighting-up said tungsten filament in the presence of said forming gas;
(d) evacuating said envelope when said lighting-up ceases;
(e) depositing a getter forming component into said envelope;
(f) lighting-up said tungsten filament in the presence of said getter forming component to deposit a getter material in said envelope;
(g) re-evacuating said envelope;
(h) filling said envelope with a desired fill gas; and
(i) sealing said envelope.

16. A method as described in claim 15 wherein said inert gas is nitrogen.

17. A method as described in claim 16 wherein said getter forming component is a mixture of phosphine in nitrogen and said getter material is elemental phosphorus.

18. A method as described in claim 17 wherein said getter forming component is one percent phosphine in nitrogen.

19. A method as described in claim 1 wherein said electric lamp comprises a tungsten halogen capsule.

20. A method as described in claim 19 wherein said inert gas is nitrogen.

* * * * *